US008353715B1

(12) United States Patent
Zhou

(10) Patent No.: US 8,353,715 B1
(45) Date of Patent: Jan. 15, 2013

(54) ELECTRONIC DEVICE HAVING ASSISTING APPARATUS FOR UNPLUGGING RJ-45 CONNECTOR

(75) Inventor: Hai-Qing Zhou, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/284,962

(22) Filed: Oct. 30, 2011

(30) Foreign Application Priority Data

Sep. 20, 2011 (CN) ..... 2011 1 0279534

(51) Int. Cl.
*H01R 13/627* (2006.01)

(52) U.S. Cl. ..... 439/352

(58) Field of Classification Search ..... 439/352, 439/344, 258, 260, 490, 489
See application file for complete search history.

(56) References Cited

U.S. PATENT DOCUMENTS 5,120,255 A * 6/1992 Kouda et al. ..... 439/489
5,971,777 A * 10/1999 Garside ..... 439/131
6,126,480 A * 10/2000 Kawase et al. ..... 439/489
6,312,293 B1 * 11/2001 Wang ..... 439/677
7,651,361 B2 * 1/2010 Henry et al. ..... 439/352
7,686,638 B2 * 3/2010 Boyd et al. ..... 439/344
7,901,250 B2 * 3/2011 Lam et al. ..... 439/638
8,057,252 B2 * 11/2011 Sun ..... 439/490
8,202,110 B2 * 6/2012 Morrison et al. ..... 439/344
8,221,156 B2 * 7/2012 Sun ..... 439/490
8,267,712 B2 * 9/2012 Huang et al. ..... 439/352
2008/0132101 A1 * 6/2008 Gundlach et al. ..... 439/266
2009/0004904 A1 * 1/2009 Caveney et al. ..... 439/344
2009/0007609 A1 * 1/2009 Obenshain ..... 70/158
2011/0111617 A1 * 5/2011 Handshaw et al. ..... 439/352

* cited by examiner

*Primary Examiner* — Alexander Gilman
(74) *Attorney, Agent, or Firm* — Altis Law Group, Inc.

(57) ABSTRACT

An electronic device includes a chassis and an assisting apparatus for unplugging a Registered Jack-45 (RJ-45) connector. The chassis includes a sidewall defining an opening, and a connector installed in the chassis and exposed through the opening. The assisting apparatus includes a press member fixed to the chassis, and an operation member slidably connected to the press member. The press member includes a resilient arm, a press portion protruding up from the resilient arm, and a block protruding down from the resilient arm. The operation member includes a push wall facing the block. When the operation member is slid, the push wall abuts against the block and pushes the resilient arm upwards, the press portion of the resilient arm is moved upwards, for disengaging the resilient plate of the RJ-45 connector from the connector of the chassis.

7 Claims, 4 Drawing Sheets

ELECTRONIC DEVICE HAVING ASSISTING APPARATUS FOR UNPLUGGING RJ-45 CONNECTOR

BACKGROUND

1. Technical Field

The present disclosure relates generally to electronic devices and, particularly, to an electronic device having an assisting apparatus for unplugging a Registered Jack-45 (RJ-45) connector.

2. Description of Related Art

RJ-45 connectors are widely used in network communication. However, unplugging an RJ-45 connector manually from a connector of an electronic device can be difficult and inconvenient because of limited operational space.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
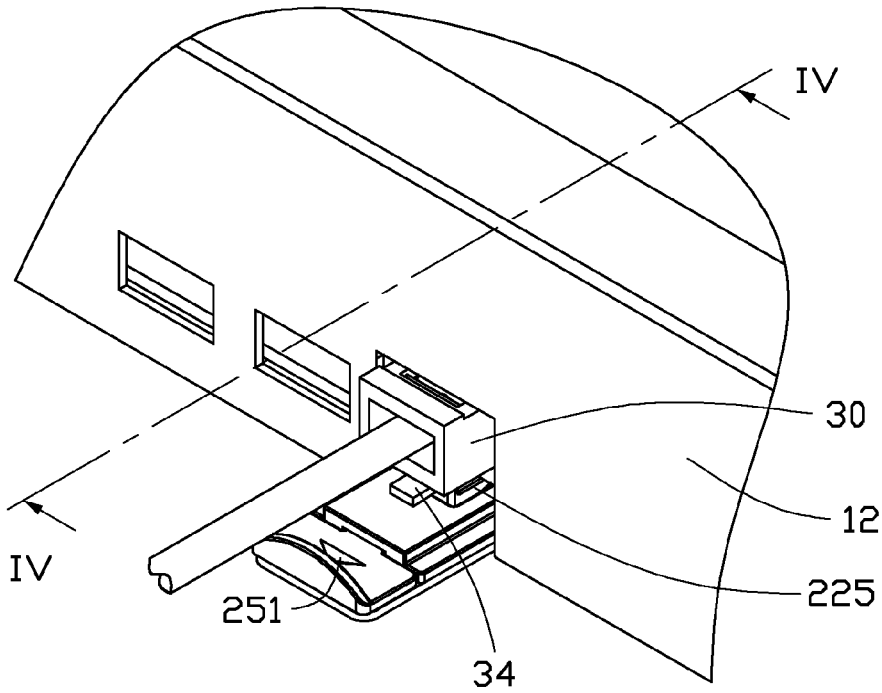
FIG. 1 is an assembled, isometric view of an exemplary embodiment of an electronic device together with a Registered Jack-45 (RJ-45) connector, wherein the electronic device includes an assisting apparatus for unplugging the RJ-45 connector.
Figure 2:
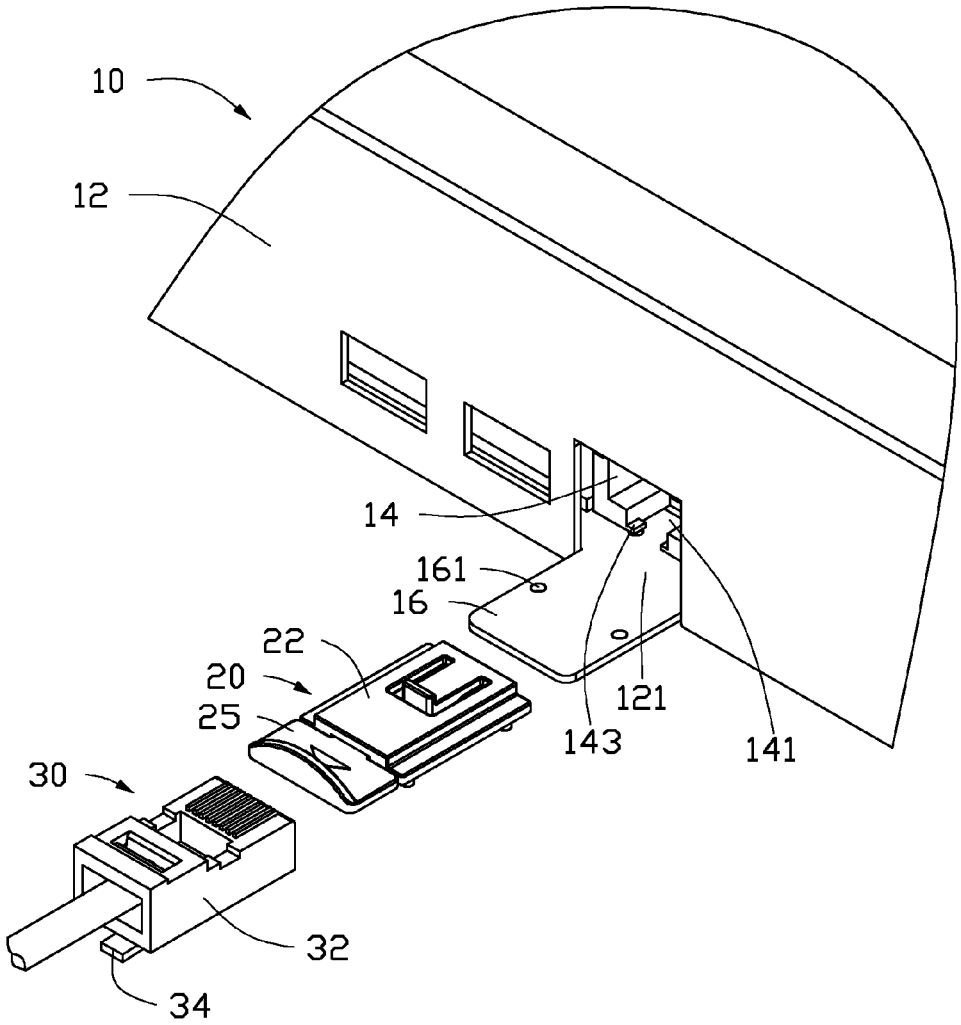
FIG. 2 is an exploded, isometric view of FIG. 1.

Referring to FIGS. 1 and 2, an exemplary embodiment of an electronic device includes a chassis 10, and an assisting apparatus 20 for unplugging a Registered Jack-45 (RJ-45) connector 30.

The RJ-45 connector 30 includes a connecting portion 32, and a resilient plate 34 slantingly extending down from the bottom of the connecting portion 32.

The chassis 10 includes a sidewall 12 defining an opening 121 therein. A connector 14 is mounted inside the chassis 10 and exposed through the opening 121, for being electrically connected to the RJ-45 connector 30. A receiving space 141 having a substantially T-shaped cross-section is defined in the rear end of the connector 14 aligning with the opening 121, with the bottom of the receiving space 141 extending through the bottom of the connector 14. Two protrusions 143 extend toward each other from rear ends of the bottoms of two opposite inner walls of the receiving space 141. A fixing plate 16 is formed on the chassis 10 below and spaced from the connector 14, with the rear end of the fixing plate 16 extending out of the sidewall 12 through the opening 121. A plurality of fixing holes 161 is defined in the fixing plate 16.

Figure 3:
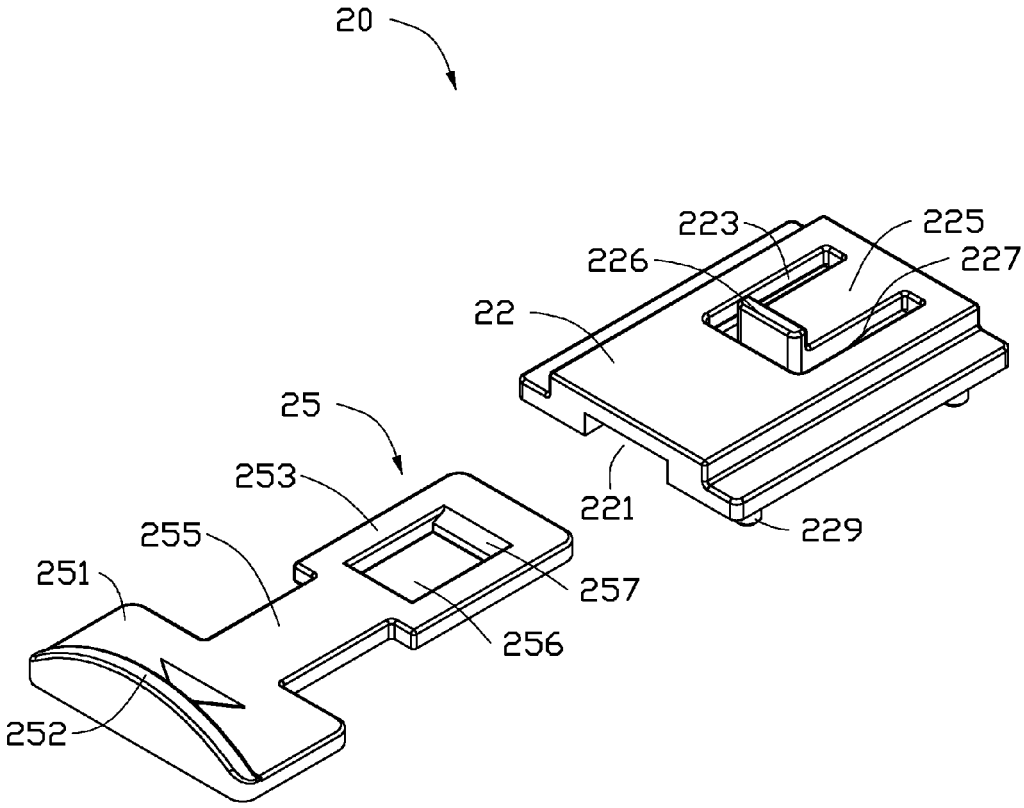
FIG. 3 is an exploded, isometric view of the assisting apparatus of FIG. 1.
Figure 4:
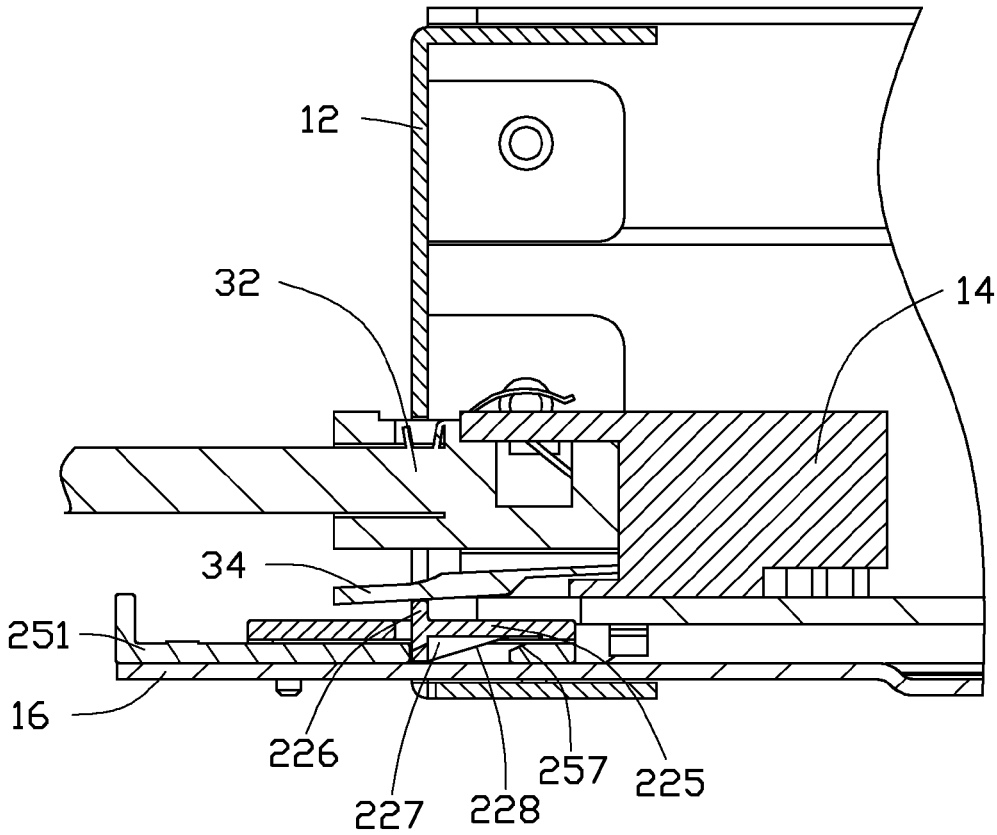
FIG. 4 is a cross-sectional view taken along the line IV-IV of FIG. 1.

Referring to FIGS. 3 and 4, the assisting apparatus 20 includes a press member 22 and an operation member 25.

A substantially T-shaped slide slot 221 is defined in the bottom of the press member 22. A width of the front end of the slide slot 221 is greater than a width of the rear end of the slide slot 221. The rear end of the slide slot 221 extends through the rear end of the press member 22. A through slot 223 communicating with the slide slot 221 is defined in the top of the press member 22, adjacent to the front end of the press member 22. A resilient arm 225 extends into the through slot 223 from a portion of the press member 22 adjoining the front end of the through slot 223. A press portion 226 protrudes up from the rear end of the resilient arm 225. Two spaced blocks 227 which are substantially wedge-shaped extend down from the rear end of the resilient arm 225. Each block 227 includes a slanted surface 228 upwardly connected to a middle section of the bottom of the resilient arm 225. A plurality of feet 229 is formed on the bottom of the press member 22.

The operation member 25 includes an operation portion 251, a push portion 253, and a connecting portion 255 connected between the operation portion 251 and the push portion 253. A width of the connecting portion 255 is less than a width of the operation portion 251 and a width of the push portion 253. A handle 252 extends up from a rear end of the operation portion 251 away from the push portion 253. A receiving slot 256 is defined in a middle of the push portion 253. A push wall 257 slantingly extends down and back from a section of the push portion 253 adjoining the front end of the receiving slot 256.

Referring to FIGS. 1 and 4, in assembly, the push portion 253 and the connecting portion 255 is slidably received in the slide slot 221. The blocks 227 are received in the receiving slot 256. The push member 22 and the operation member 25 are inserted into a space between the connector 14 and the fixing plate 16, to allow the feet 229 to engage in the fixing holes 161, respectively. Thereby, the assisting apparatus 20 is fixed to the chassis 10. The resilient arm 225 is aligned with the receiving space 141, with the press portion 226 arranged under and behind the connector 14.

To plug the RJ-45 connector 30 into the connector 14, the connecting portion 32 is inserted into the receiving space 141, with opposite sides of the resilient plate 34 adjacent to the connecting portion 32 engaging with the protrusions 143, respectively. The rear end of the resilient plate 34 is exposed out of the receiving space 141, and aligns with the top of the press portion 226.

To unplug the RJ-45 connector 30 from the connector 14, the handle 252 is pulled backwards. The push portion 253 and the connecting portion 255 are slid backwards along the slide slot 221. The push wall 257 abuts against the slanted surface 228 and pushes the resilient arm 225 upwards. The press portion 226 pushes the resilient plate 34 upwards, to allow the resilient plate 34 to disengage from the protrusions 143. Thereby, the RJ-45 connector 30 can be detached from the connector 14.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An electronic device, comprising:

a chassis comprising a sidewall defining an opening therein, and a connector installed in the chassis and exposed through the opening, for being connected to a Registered Jack-45 (RJ-45) connector having a resilient plate; and an assisting apparatus for unplugging the RJ-45 connector from the connector of the chassis, the assisting apparatus comprising a press member fixed to the chassis, and an operation member slidably connected to the press member, the press member comprising a resilient arm, a press portion protruding up from the resilient arm, and a block protruding down from the resilient arm, the operation member comprising a push wall facing the block, wherein when the operation member is slid back, the push wall abuts against the block and pushes the resilient arm upwards, the press portion of the resilient arm is moved upwards to disengage the resilient plate of the RJ-45 connector from the connector of the chassis.

2. The electronic device of claim 1, wherein a slide slot is defined in a bottom of the press member, the operation member comprises an operation portion extending out of the slide slot, a push portion slidably received in the slide slot, and a connecting portion connected between the operation portion and the push portion.

3. The electronic device of claim 2, wherein a through slot is defined in a top of the press member communicating with the slide slot, the resilient arm extends into the through slot from a portion of the press member adjoining a front end of the through slot, the press portion and the block respectively extend up and down from a rear end of the resilient arm.

4. The electronic device of claim 3, wherein the block comprises a slanted surface upwardly connected to a middle section of a bottom of the resilient arm, the push wall of the operation member slantingly extends down and back, when the operation portion is pulled backwards, the push wall abuts against the slanted surface of the block, to allow the resilient arm to move upwards.

5. The electronic device of claim 4, wherein a receiving slot is defined in a middle of the push portion, the block is received in the receiving slot, and the push wall is formed on a section of the push portion adjoining a front end of the receiving slot.

6. The electronic device of claim 1, wherein a fixing plate is formed on the chassis below and spaced from the connector, a rear end of the fixing plate is extended out of the sidewall of the chassis through the opening, and the assisting apparatus is mounted between the fixing plate and the connector.

7. The electronic device of claim 6, wherein a plurality of fixing holes is defined in the fixing plate, and a plurality of feet is formed on a bottom of the press member, to engage in the fixing holes.

* * * * *